US007703165B2

(12) United States Patent
Wilkins

(10) Patent No.: US 7,703,165 B2
(45) Date of Patent: Apr. 27, 2010

(54) PORTABLE SCRUBBING APPARATUS

(76) Inventor: Larry C. Wilkins, 3113 Brazil Lake Pkwy., Georgetown, IN (US) 47122

( * ) Notice: Subject to any disclaimer, the term of this patent is extended or adjusted under 35 U.S.C. 154(b) by 1224 days.

(21) Appl. No.: 11/254,647

(22) Filed: Oct. 20, 2005

(65) Prior Publication Data

US 2007/0089252 A1 Apr. 26, 2007

(51) Int. Cl.
*A46B 13/06* (2006.01)

(52) U.S. Cl. ..... 15/23; 15/24; 15/97.1

(58) Field of Classification Search ..... 15/23, 15/179, 97.1, 24; 451/466
See application file for complete search history.

(56) References Cited

U.S. PATENT DOCUMENTS

| | | | | |
|---|---|---|---|---|
| 518,352 | A | 4/1894 | Nightingale | |
| 717,851 | A * | 1/1903 | Hirsch | 15/198 |
| 843,377 | A | 3/1907 | Kudrie et al. | |
| 1,414,605 | A | 5/1922 | Tolookjian | |
| 1,423,844 | A | 7/1922 | Fenelon | |
| 1,817,644 | A | 8/1931 | Pope | |
| 2,723,407 | A | 11/1955 | Bardon | |
| 3,599,267 | A | 8/1971 | Faires | |
| 3,748,678 | A | 7/1973 | Ballou | |
| 4,461,052 | A | 7/1984 | Mostul | |
| 4,581,785 | A | 4/1986 | Suzuki | |
| 4,780,922 | A | 11/1988 | Sanchez | |
| 4,780,992 | A | 11/1988 | McKervey | |
| 5,146,642 | A | 9/1992 | Mank et al. | |
| 5,235,717 | A | 8/1993 | Lanzo, Jr. et al. | |
| 5,301,472 | A | 4/1994 | Lyng | |
| 5,987,682 | A | 11/1999 | Rossi | |
| 6,076,984 | A * | 6/2000 | Legrain et al. | 401/1 |
| 6,594,843 | B1 | 7/2003 | Wilkins | |
| 6,792,639 | B2 | 9/2004 | Wilkins | |
| 2002/0157255 | A1 * | 10/2002 | Coffin | 30/41 |
| 2003/0133736 | A1 * | 7/2003 | Van Steenbergen | 401/1 |

* cited by examiner

*Primary Examiner*—David B Thomas
(74) *Attorney, Agent, or Firm*—Finnegan, Henderson, Farabow, Garrett & Dunner, L.L.P.

(57) ABSTRACT

A portable cleaning apparatus includes a handle and a wheel rotatably mounted to the handle having a plurality of scrubbing elements. A nozzle delivers fluid to the scrubbing elements to effect rotation of the wheel. The scrubbing elements can be secured to the wheel to limit pivoting movement of the scrubbing element in a direction of rotation of the wheel while permitting greater pivoting movement of the scrubbing elements in a direction opposite the direction of rotation of the wheel. A dispensing system mounted to the handle is remotely operable to position a dispenser of treatment material in the rotational path of the scrubbing elements to apply treatment material to the scrubbing elements.

17 Claims, 6 Drawing Sheets

PORTABLE SCRUBBING APPARATUS

BACKGROUND

Devices for cleaning or preparing surfaces have been provided. Such devices have included rotary brushes that are propelled by fluid delivered thereto through the device. The rotary force provided by directing fluid to the brush can encounter resistance when other portions of the brush are positioned against a treatment surface, preventing the brush from rotating effectively along the treatment surface. It may further be desirable to deliver treatment material to treat the surface being cleaned. The ability to deliver the treatment material at the desired time and in the desired amount without stopping cleaning of the treatment surface can improve efficiencies in cleaning the treatment surface and reduce waste of treatment material.

SUMMARY

Described briefly, the illustrated embodiment includes a handle with a fitting for connection to an external pressurized water or other fluid supply; a rotatable wheel at an end of the handle having surface scrubbing elements thereon; and a nozzle to direct high velocity of fluid discharge onto the wheel.

In one embodiment, the scrubbing elements can be configured to receive the fluid on a first side thereof while maintaining a generally radial orientation relative to the wheel and to pivot from the generally radial orientation when a second side thereof encounters a treatment surface.

In another embodiment, a dispensing system is provided that is operable to move a dispenser of treatment material from a first position outside the rotary path of the scrubbing elements to a second position in the path of the scrubbing elements to deliver treatment material to respective scrubbing elements passing thereby and which treatment material is thereafter delivered to the treatment surface by the scrubbing elements.

Further embodiments, forms, features, aspects, benefits, objects, and advantages of the present application shall become apparent from the detailed description and figures provided herewith.

DETAILED DESCRIPTION OF SELECTED EMBODIMENTS

Figure 1:
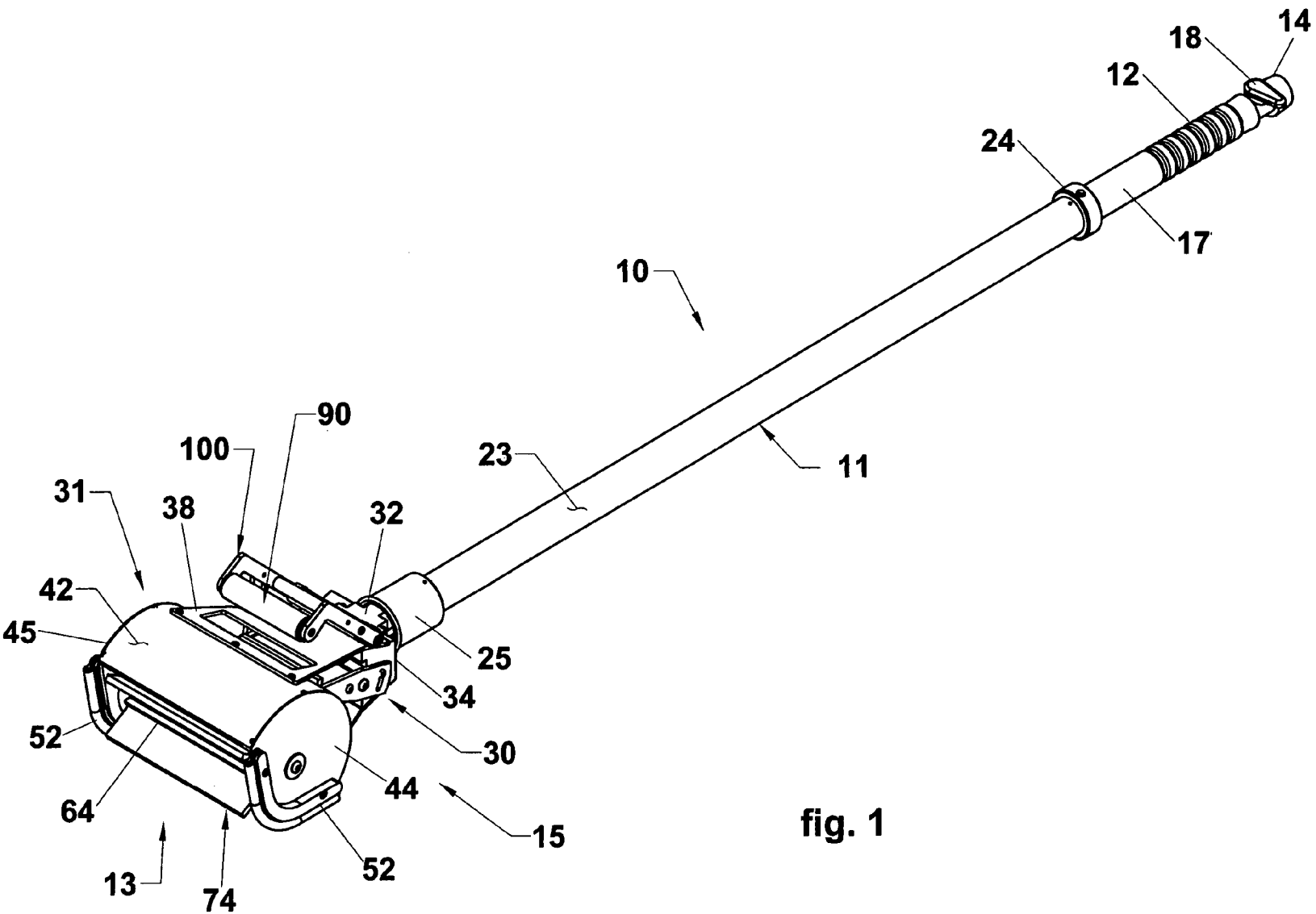
FIG. 1 is a perspective view of a portable scrubbing apparatus looking toward its distal end.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
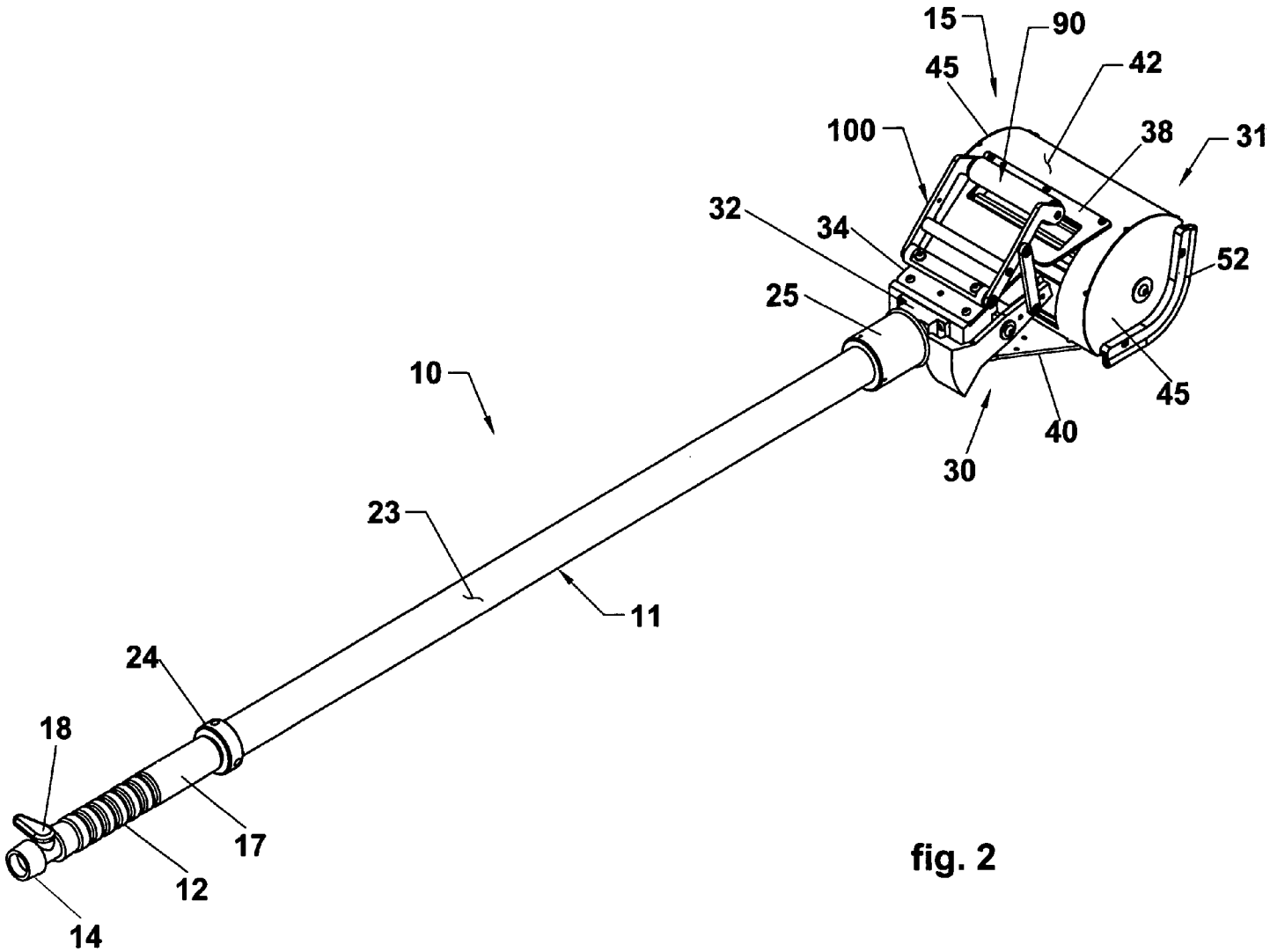
FIG. 2 is a perspective view of the portable scrubbing apparatus of FIG. 1 looking toward its proximal end.
Figure 3:
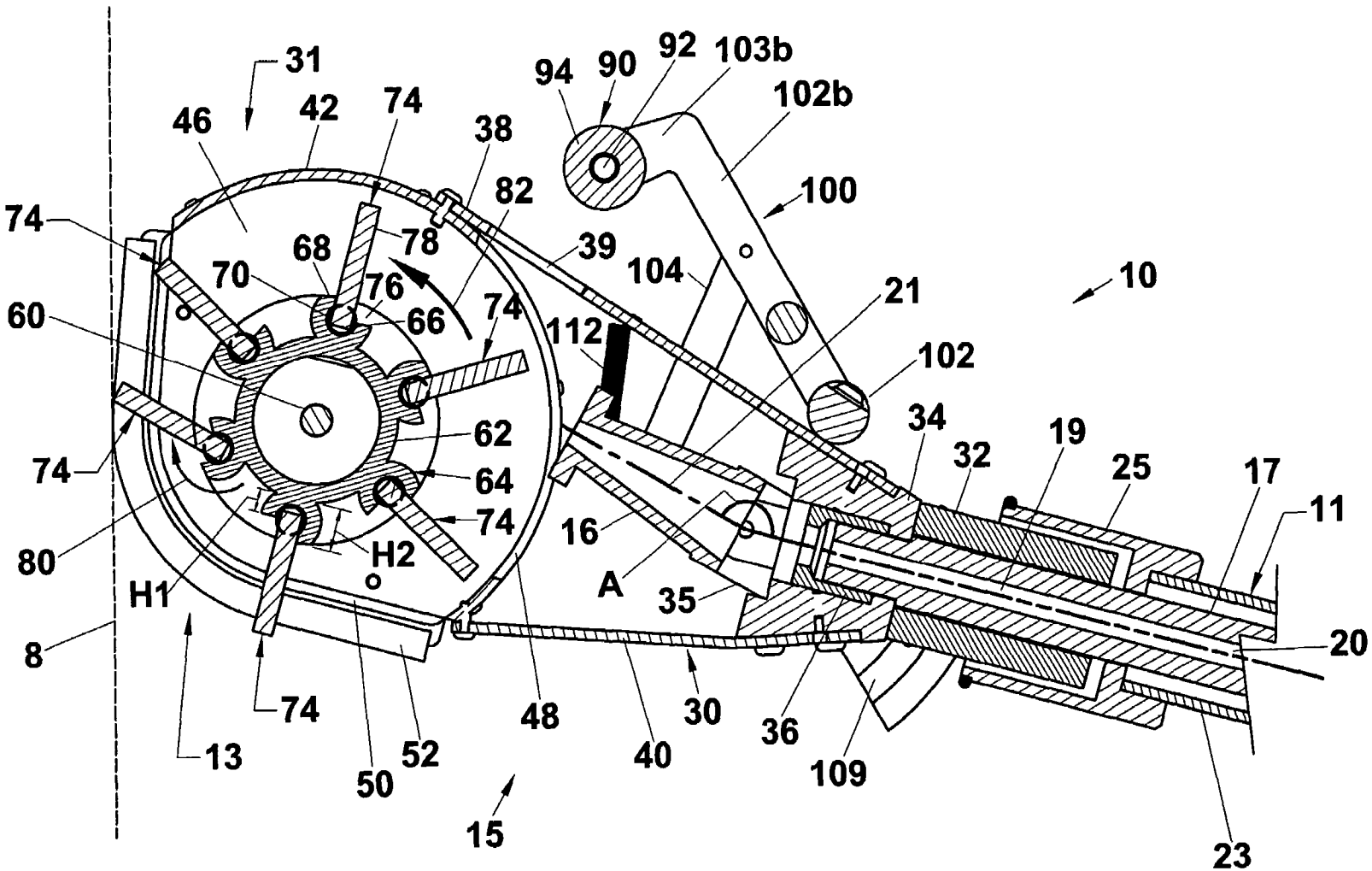
FIG. 3 is a longitudinal sectional view of a distal portion of the portable scrubbing apparatus of FIG. 1.
Figure 4:
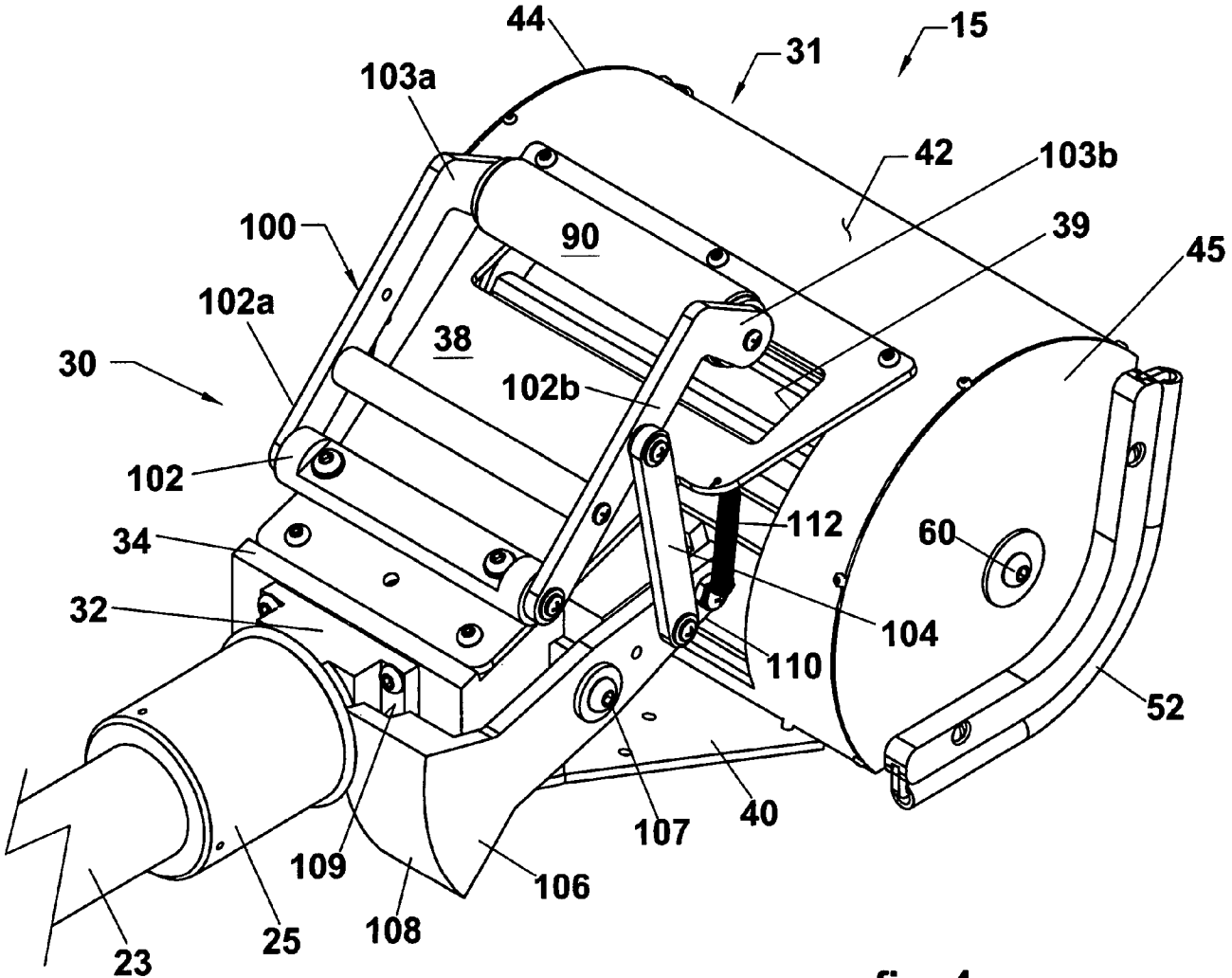
FIG. 4 is a perspective view looking toward the proximal side of the distal end portion of the portable scrubbing apparatus of FIG. 1.
Figure 5:
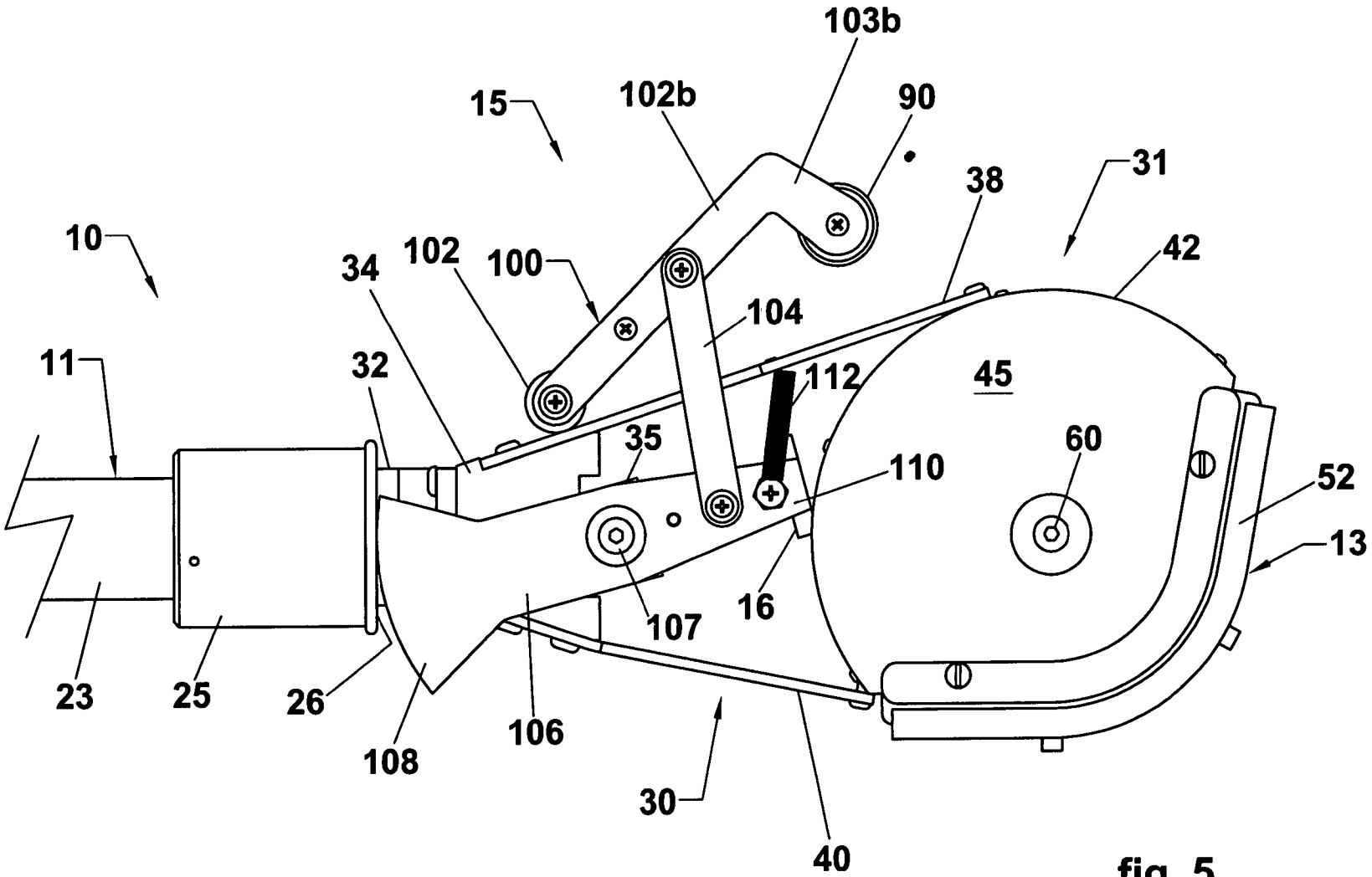
FIG. 5 is an elevational view of the distal portion of the portable scrubbing apparatus of FIG. 1 with a treatment material dispenser and dispensing system in a first position.

Referring now to FIGS. 1-3, a portable scrubber apparatus 10 includes a handle 11 having a hand grip 12 at one end and a scrubbing wheel 13 at the other end. A hose connector 14 at the proximal end provides for convenient attachment to a conventional garden hose or other fluid source (not shown) whereby water or other fluid may be supplied under pressure from through valve 18 to the tube 17. Valve 18 can be selectively opened and closed by the user to permit, restrict or prevent water flow into a lumen 20 of tube 17. Any suitable valve is contemplated for valve 18. Water from lumen 20 is delivered to a nozzle 16 mounted adjacent a distal end opening of lumen 20 within a housing assembly 15

An actuator 23 extends about tube 17 from a proximal coupling 24 to a distal end member 25. Actuator 23 includes an elongated tubular arrangement that extends concentrically about and is spaced from tube 17. Proximal coupling 24 secures actuator 23 to tube 17 and maintains it in axial relation therewith. Actuator 23 and distal end member 25 are rotatable about tube 17 by the user grasping actuator 23 and rotating it about its longitudinal axis. The purpose and functioning of actuator 23 will be discussed further below.

Handle 11 includes housing assembly 15 to rotatably mount scrubbing wheel 13 thereto. Housing assembly 15 includes a mounting portion 30 extending from tube 17 and a housing portion 31 for housing wheel 13. The mounting portion 30 can include a tube mount 32 positioned about and coupled to the distal end of tube 17. Any suitable coupling arrangement is contemplated, including threadingly engaging, frictionally engaging, welding, and/or adhering tube mount 32 to tube 17. Tube mount 32 can be coupled to the proximal end of a base member 34. Base member 34 can be axially secured on tube 17 with a retaining sleeve 36 that clamps base member 34 between tube mount 32 and retaining sleeve 36. Sleeve 36 can also be engaged about tube 17 using any suitable connection arrangement.

Base member 34 further includes nozzle mounts 35 in mounting portion 30 to which nozzle 16 is mounted. Base member 34 and retaining sleeve 36 each include a central passage that align with lumen 20 to provide a fluid path for delivery of fluid from lumen 20 to nozzle 16. Lumen 20 extends along a longitudinal axis 19 that intersects the rotational axis of wheel 13. Nozzle 16 defines a distally tapered lumen that extends along an axis 21. Axis 21 can be angled at an angle A relative to axis 19 to direct the fluid in a desired direction relative to scrubbing wheel 13 at a location offset radially from its rotational axis thereby effecting rotation of wheel 13 as the fluid impinges on radially extending scrubbing elements 74 passing by nozzle 16.

Mounting portion 30 of housing assembly 15 further includes an upper plate 38 having a distal end coupled to base member 34 and a proximal end coupled to a housing 42 of housing portion 31. Mounting portion 30 also includes a lower plate 40 having a distal end coupled to base member 34 and a proximal end coupled to housing 42 of housing portion 31. Nozzle 16 resides between plates 38, 40, which along with housing 42 can reduce or eliminate splashing or splattering of fluid on the user.

Housing 42 forms a partially cylindrical structure having opposite endwalls 44, 45 and a central space 46 defined thereby. Scrubbing wheel 13 is rotatably mounted to endwalls 44, 45 within space 46. Housing 42 further defines a proximal opening 48 adjacent nozzle 16 to receive fluid from nozzle 16 into space 46. Housing 42 also defines a distal opening 50 through which portions of scrubbing wheel 13 extend for positioning in contact with treatment surface 8.

The edges of housing 42 defining distal opening 50 can be lined with a protective member 52 to prevent damage to treatment surface 8 as housing 42 is moved therealong. Protective member 52 can be a rubber, elastomeric or other suitable non-rigid or non-abrasive material that flexes, slides, rotates or otherwise facilitates movement along treatment surface 8 when positioned thereagainst to prevent damage to the treatment surface. Protective member 52 can be provided with one or more elements that facilitate movement along the treatment surface, such as wheels, rollers, anti-friction coatings or lubricants, for example.

Scrubbing wheel 13 includes a central axle 60 rotatably mounted to endwalls 44, 45 of housing 42. A wheel hub 62 is positioned about and rotatable with axle 60. Wheel hub 62 includes a plurality of mounting elements 64 positioned circumferentially thereabout. Mounting elements 64 can each include a first retaining member 66 and a second retaining member 68 defining a receptacle 70 therebetween. Retaining members 66, 68 can each include concavely curved surfaces oriented toward one another defining receptacle 70. Scrubbing elements 74 are mountable in respective ones of the mounting elements 64 in a manner extending generally radially outwardly from the rotational axis of scrubbing wheel 13.

Scrubbing elements 74 each include an engaging member 76 that is positionable in receptacle 70 and a treatment portion 78 extending outwardly from engaging member 76. Engaging member 76 is rotatable in receptacle 70 so that treatment portions 78 can pivot in the direction opposite the rotational direction of wheel 13 when a second side of treatment portions 78 contact treatment surface 8, as indicated by arrow 80 in FIG. 3. Retaining member 66 permits some pivoting motion of scrubbing element 74 from its generally radially extending orientation to reduce forces that tend to counter the rotational force supplied by the fluid delivered from nozzle 16 to the first side of treatment portion 78. In the illustrated embodiment, engaging member 76 includes a rounded, rod-like profile that is rotatable within receptacle 70. Other coupling arrangements are also contemplated, including those where scrubbing elements 74 are recessed in hub 62, are attached with fasteners to hub 62, or other suitable coupling arrangements.

Second retaining member 68 includes a height H2 extending from wheel hub 62 that is greater than a height H1 of first retaining member 66. Second retaining member 68 thus extends along and contacts treatment portion 78 of the respective scrubbing element 74. As fluid from nozzle 16 is directed onto the first side of treatment portion 78, as indicated by arrow 82 in FIG. 3, second retaining element 68 resists pivoting of scrubbing element 74 in the direction in which wheel 13 is rotating (counterclockwise in FIG. 3) and maintains it in the generally radially extending direction. This results in force from the fluid being transmitted from scrubbing element 74 into rotary action of the wheel 13, preventing or reducing the potential for wheel 13 to slow or stop as the second side of treatment portions 78 contact treatment surface 8. In contrast, first retaining member 66 allows the scrubbing elements 74 coupled thereto to pivot from its radially extending orientation in the direction opposite the rotational direction of wheel 13. This allows scrubbing elements 74 to conform to the surface profile of the treatment surface 8 as wheel 13 is moved thereacross, and reduces resistance to rotation of wheel 13 when the treatment portions 78 contact treatment surface 8.

Scrubbing elements 74 can include treatment portions 78 in the form of wash cloth material, brush material, or rubber material, for example, that are mounted on the wheel. Scrubbing elements 74 include sufficient rigidity to transfer energy from the fluid delivered by nozzle 16 into rotary movement of wheel 13. Treatment portions 78 can be integrally formed with or removable from engaging member 76. It is further contemplated that the scrubbing elements 74 and/or treatment portions 78 can be removable or expendable units which may be clipped, pinned, snapped-onto, or otherwise mounted on wheel hub 62 or engaging members 76. In another form, the entire hub 62 is expendable or removable such that, when elements become worn, or a different type is needed, the entire hub including scrubbing elements is replaced.

Portable scrubbing apparatus 10 may further include a treatment material dispenser 90 and a dispensing system 100. Dispensing system 100 includes a bracket 102 having arms 102*a*, 102*b* pivotally mounted to upper plate 38 at one end of the arms 102, 102*b*. The opposite ends of the arms 102*a*, 102*b* include an L-shaped portion 103*a*, 103*b*, respectively. Treatment material dispenser 90 is rotatably mounted to and extends between the outer ends of the L-shaped portions 103*a*, 103*b*.

Dispensing system 100 further includes a link 104 having a first end pivotally coupled to arm 102*b* and a second end pivotally coupled to a cam 106. Cam 106 is also pivotally mounted to base member 134 about a pin 107. The distal end 110 of cam 106 is engaged to a biasing member 112. Biasing member 112 extends from distal end 110 to upper plate 38. Cam 106 further includes a cam surface 108 along an end thereof opposite distal end 110. Cam surface 108 is formed by an extension portion 109 that extends to a location adjacent to and in contact with distal end wall 26 of actuator 23. Cam surface 108 is curved along an arc so that contact with distal end wall 26 is maintained as cam is pivoted about pin 107.

Figure 6:
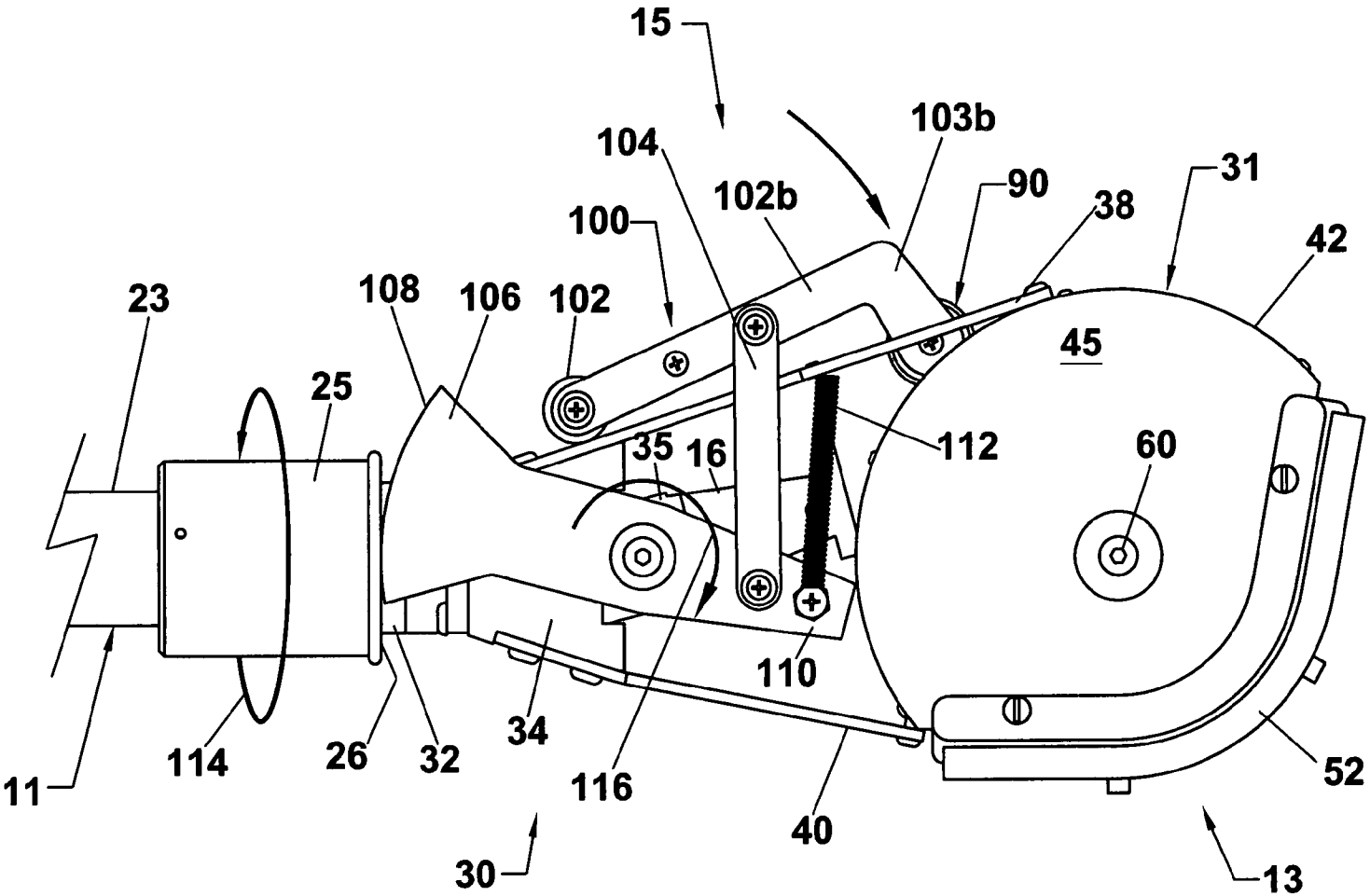
FIG. 6 is an elevational view of the distal portion of the portable scrubbing apparatus of FIG. 1 with a treatment material dispenser and dispensing system in a second position.

Dispensing system 100 includes a first position shown in FIGS. 1-5 where treatment material dispenser 90 is removed from space 46 and is movable with actuator 23 to a second position shown in FIG. 6 where treatment material dispenser 90 is disposed within space 46. Biasing member 112 normally biases treatment material dispenser 90 to the first position. In the illustrated embodiment, biasing member 112 is a spring that is normally compressed to pull distal end 110 of cam 106 toward upper plate 38. Rotation of actuator 23 in the direction of arrow 114 (FIG. 6) causes distal end wall 26 to rotate while in contact with cam surface 108. Cam surface 108 follows the rotational movement of end wall 26, which in turn causes cam 106 to rotate in the direction of arrow 116 (FIG. 6) moving distal end 110 downwardly against the bias of biasing member 112. As cam 106 is rotated, link 104 pulls arms 102*a*, 102*b* down toward upper plate 38 about their pivotal coupling with base 34 so that material dispenser 90 is received through window 39 of upper plate 38 and into space 46 of housing 42 in its second position. In the second position, the second sides of treatment portions 78 (opposite the side to which nozzle 16 is directed) of scrubbing elements 74 can contact material dispenser 90 so that treatment material is applied to the respective treatment portions 78 passing thereagainst. Treatment portions 78 can then apply the treatment material to the treatment surface 8 as they pass therealong.

When it is no longer desired to apply treatment material to treatment portions 78, actuator 23 can be released. Biasing member 112 pulls distal end 110 of cam 106 toward plate 38, pivoting cam 106 about pin 107 in the direction opposite arrow 116 back to its position shown in FIG. 5. Link 104 simultaneously pushes arms 102*a*, 102*b* of bracket assembly 102 upwardly away from upper plate 138, withdrawing material dispenser 90 through window 39 to its first position. Actuator 23 is also automatically rotated in the direction opposite arrow 114 by the force exerted by cam surface 108 of cam 106 on distal end wall 26 as cam 106 is pivoted by biasing member 112.

In the use of the portable scrubbing apparatus 10, it may first be connected to the garden hose or other suitable water supply with connector 14. Then the water supply is turned on with valve 18 opened or closed. The user may, if necessary, open valve 18 slightly or completely depending on the desired water flow to be discharged by nozzle 16 on the scrubbing elements 74. Housing 42 may be positioned along the treatment surface 8 so that treatment portions 78 of scrubbing elements 74 contact the treatment surface. If treatment material is desired to be applied, then actuator 23 can be rotated with one hand by the user while the other hand is engaged to hand grip 12. Rotation of actuator 23 moves dispensing system 100 and displaces material dispenser 90 into space 46 where it is contacted by the rotating scrubbing elements 74 passing thereby. When the desired treatment material has been delivered, actuator 23 is released and material dispenser 90 automatically returns to its first position out of space 46 by dispensing system 100.

Of course, the width of the wheel and particularly, the scrubbing elements 74 will depend upon the desired size of the apparatus, the water pressure and volume of water available. The overall length from grip 12 to wheel 13 can be such as desired for the particular application, and the convenience of the user. It is expected that the width of scrubbing elements 74 and/or housing 42 could be from two to twenty-four inches. The overall length of handle from end-to-end is expected to be between about six inches and six feet or more, again depending on the application. It could easily be up to six feet or more for floor or wall scrubbing. Handle 11 could also be adjustable in length to accommodate the size of the user and the nature of the task.

Material dispenser 90 can be constructed to include a roller 92 with opposite ends rotatably mounted to respective ends of L-shaped portions 103*a*, 103*b*. Treatment material 94 can be provided about the outside of the roller 92 in one or more layer of a solid form extending about all or a portion of roller 92. The treatment material can slow wears away as it is delivered to the scrubbing elements 74 upon rotation of roller 92 about its longitudinal axis. Treatment material 94 can be provided in engagement with roller 92 so that it rotates therewith. In another embodiment, treatment material is provided about a sleeve that rotates relative to roller 92, and the ends of roller 92 are fixed relative to the ends of L-shaped portions 103*a*, 103*b*. Any suitable treatment material is contemplated, including soap, wax, and cleaning agents, for example. Material dispenser 90 can be readily removed from between arms 103*a*, 103*b* when the dispenser is empty or devoid of treatment material so that either a replacement dispenser can be positioned therebetween or the treatment material about roller 92 can be replaced.

In another embodiment, the material dispenser is in the form of a container in housing assembly 15 and in which soap or other treatment material is deposited. The container can include openings or passages that allow the scrubbing elements to contact the treatment material in the container for application to the scrubbing elements. The container can include a door or wall that is movable to block the openings or passages and prevent contact of the scrubbing elements and/or the fluid in housing assembly 15 with the treatment material. The container can also be moveable into and out of housing assembly 15, such as discussed above with respect to material dispenser 90, to allow selective application of the treatment material to the scrubbing elements. In a further variation, the treatment material can be dispensed from the container by changing from solid to liquid form upon contact with the water or other fluid in housing assembly 15. In still another variation, a material dispenser is provided that contains liquid treatment material. The liquid treatment material is selectively applied to the scrubbing elements by releasing, spraying or otherwise depositing the treatment material on the scrubbing elements.

Various materials of construction may be used. The housing may be made of metal or plastic for example, and portions of the housing which may inadvertently contact a fragile or decorative surface may be edged with a soft protective material such as soft plastic or soft rubber such as at protective member 52. Treatment surface 8 can be any surface for which scrubbing is desired. Examples include automobiles, boats, windows, gutters, and siding.

In other embodiments, scrubbing apparatus 10 could be supplied with liquid other than water and from other than a garden hose. It could be used for surface treatment other than scrubbing. Wet sanding or polishing are two possible examples. In still other embodiments, a dispensing system is not provided.

While the invention has been illustrated and described in detail in the drawings and foregoing description, the same is to be considered illustrative and not restrictive in character, it being understood that only selected embodiments have been shown and described and that all changes, equivalents, and modifications that come within the scope of the inventions described herein or defined by the following claims are desired to be protected.

What is claimed is:

1. An apparatus for scrubbing a surface, comprising:

a handle;

an inlet for coupling to a fluid supply and a nozzle for delivering fluid from said inlet;

a wheel rotatably mounted to said handle, said wheel including a plurality of scrubbing elements, wherein said wheel rotates in response to delivery of fluid from said nozzle to a first side of said scrubbing elements as said scrubbing elements pass by said nozzle in a rotation direction of said wheel; and said wheel includes a hub including a plurality of receptacles for coupling respective ones of said scrubbing elements thereto, at least one of said receptacles being formed by first and second retaining elements, wherein said first retaining element extends along said first side of said scrubbing element and said second retaining element extends along a second side of said scrubbing element opposite said first side, said second retaining element having a height extending from said hub that is greater than a height of said first retaining element extending from said hub, wherein said second retaining element is configured to prevent said scrubbing element from pivoting in said rotation direction and said first retaining element is configured to permit said scrubbing element to pivot opposite said rotation direction.

2. The apparatus of claim 1, wherein said first and second retaining elements each include a concavely curved surface oriented toward the other forming said receptacle, and said scrubbing element includes an engaging member rotatably received in said receptacle.

3. The apparatus of claim 1, wherein each of said receptacles is formed by first and second retaining elements, wherein each of said first retaining elements extends along said first side of said respective scrubbing element and each of said second retaining elements extends along a second side of said respective scrubbing element opposite said first side, each of said second retaining elements having a height extending from said hub that is greater than a height of each of said first retaining elements extending from said hub.

4. The apparatus of claim 1, wherein said wheel is mounted in a housing configured to extend partially about said wheel, said housing defining a proximal opening adjacent said nozzle to receive fluid from said nozzle to said scrubbing elements, said housing further including a distal opening through which said scrubbing elements extend for positioning in contact with a treatment surface adjacent said distal opening.

5. An apparatus for scrubbing a surface, comprising:

a handle;

an inlet for coupling to a fluid supply and a nozzle for delivering fluid from said inlet;

a wheel rotatably mounted to said handle, said wheel including a plurality of scrubbing elements, wherein said wheel rotates in response to delivery of fluid from said nozzle to said scrubbing elements as said scrubbing elements pass by said nozzle; and a treatment material dispenser mounted to said handle and having a first position wherein said scrubbing elements do not contact said treatment material dispenser as said wheel rotates, said treatment material dispenser being coupled to and movable with an actuator to a second position wherein said scrubbing elements contact said treatment material dispenser as said wheel rotates respective ones of said scrubbing elements past said treatment material dispenser, wherein said nozzle delivers fluid to a first side of said scrubbing elements as said wheel rotates respective ones of said scrubbing elements by said nozzle, wherein said treatment material dispenser contacts a second side of said respective scrubbing elements opposite said first side when in said second position, and wherein said treatment material dispenser includes a roll of solid treatment material rotatable relative to said handle and said wheel in response to contact with said treatment portions passing thereby when in said second position.

6. An apparatus for scrubbing a surface, comprising:

a handle an inlet for coupling to a fluid supply and a nozzle for delivering fluid from said inlet;

a wheel rotatably mounted to said handle, said wheel including a plurality of scrubbing elements, wherein said wheel rotates in response to delivery of fluid from said nozzle to said scrubbing elements as said scrubbing elements pass by said nozzle; and a treatment material dispenser mounted to said handle and having a first position wherein said scrubbing elements do not contact said treatment material dispenser as said wheel rotates, said treatment material dispenser being coupled to and movable with an actuator to a second position wherein said scrubbing elements contact said treatment material dispenser as said wheel rotates respective ones of said scrubbing elements past said treatment material dispenser, wherein said wheel is rotatably mounted in a housing at a distal end of said handle and said treatment material dispenser is movable through a window into said housing when moving from said first position to said second position.

7. The apparatus of claim 6, wherein said housing comprises a portion of a housing assembly and further comprising a dispensing system pivotally mounted to said housing assembly, wherein said dispensing system is remotely operable by said actuator to move said treatment material dispenser between said first and second positions.

8. The apparatus of claim 7, wherein said dispensing system is normally biased to maintain said treatment material dispenser in said first position.

9. The apparatus of claim 8, wherein said dispensing system includes:

a bracket assembly pivotally mounted to said housing assembly and said treatment material dispenser is rotatably mounted to said bracket;

a cam including a distal end and a proximal cam surface, said cam being pivotably mounted to said housing assembly between said distal end and said proximal cam surface;

a link pivotally coupled at one end to said bracket assembly and at an opposite end to said cam between said distal end of said cam and said pivotal mounting location with said housing assembly; and an actuator engaged with said cam surface, said actuator being operable to move said cam surface therealong to pivot said cam about said mounting location with said housing assembly, wherein pivoting of said cam displaces said distal end of said cam and said link member to move said bracket assembly and said treatment material dispenser from said first position to said second position.

10. The apparatus of claim 9, wherein said actuator includes an elongated sleeve extending along said handle, said sleeve including a distal end wall engaging said cam surface, wherein rotation of said sleeve about a longitudinal axis rotates said distal end wall and said cam surface follows said distal end wall to pivot said cam.

11. A combination, comprising:

a portable scrubbing apparatus having an elongated handle, a wheel rotatably mounted at a distal end of said elongated handle, and a nozzle for delivering fluid to said wheel wherein said fluid rotates said wheel relative to said elongated handle; and a dispensing system including a rotatable dispenser of treatment material, said dispensing system mounted to said elongated handle and selectively moveable from a first position wherein said dispenser is located outside a rotary path of said wheel to a second position wherein said dispenser is in said rotary path of said wheel, wherein in said second position treatment material is applied to said wheel, wherein:

said wheel includes a hub and a plurality of scrubbing elements secured thereto and extending therefrom in a radial orientation;

said nozzle is arranged to direct fluid to a first side of said scrubbing elements to rotate said wheel in a first direction; and said scrubbing elements are non-pivotal from said radial orientation toward said first direction and are pivotal from said radial orientation in a second direction opposite said first direction.

12. A combination, comprising:

a portable scrubbing apparatus having an elongated handle, a wheel rotatably mounted at a distal end of said elongated handle, and a nozzle for delivering fluid to said wheel wherein said fluid rotates said wheel relative to said elongated handle; and a dispensing system including a rotatable dispenser of treatment material, said dispensing system mounted to said elongated handle and selectively moveable from a first position wherein said dispenser is located outside a rotary path of said wheel to a second position wherein said dispenser is in said rotary path of said wheel, wherein in said second position treatment material is applied to said wheel, wherein said dispensing system includes:

a bracket assembly pivotally mounted to said elongated handle at a proximal end of said bracket assembly and a distal end of said bracket assembly including said dispenser rotatably mounted thereto; and a cam linked to said bracket assembly, wherein said cam is engaged with an actuator extending along said elongated handle, said actuator being operable to pivot said cam and said bracket assembly to move said dispenser between said first and second positions.

13. The combination of claim 12, wherein said actuator includes a rotatable, elongated sleeve having a distal end in contact with a proximal cam surface of said cam, said cam surface extending along an arc.

14. An apparatus for scrubbing a surface, comprising:

a handle;

an inlet for coupling to a fluid supply and a nozzle for delivering fluid from said inlet;

a wheel rotatably mounted to said handle, said wheel including a hub and a plurality of scrubbing elements extending therefrom in a generally radial orientation, wherein:

said nozzle is arranged to direct fluid to a first side of said scrubbing elements to rotate said wheel in a first direction; and said scrubbing elements are non-pivotal from said radial orientation toward said first direction and are pivotal from said radial orientation in a second direction opposite said first direction.

15. The apparatus of claim 14, wherein said wheel includes a hub having a plurality of receptacles for coupling respective ones of said scrubbing elements thereto, at least one of said receptacles being formed by first and second retaining elements, wherein said first retaining element extends along said first side of said scrubbing element and said second retaining element extends along a second side of said scrubbing element opposite said first side, said second retaining element having a height extending from said hub along said scrubbing element that is greater than a height of said first retaining element extending from said hub along said scrubbing element.

16. The apparatus of claim 14, wherein said wheel is rotatably mounted in a space defined by a housing, said housing including distal opening through which said scrubbing elements project when adjacent thereto and a window opening into said space, and further comprising a dispensing system mounted to said handle and including a dispenser of treatment material movable with said dispensing system from a first position outside said space to a second position in said space wherein said treatment material is applied to said scrubbing elements as said scrubbing elements move thereby.

17. The apparatus of claim 16, wherein said dispensing system is coupled with an actuator extending along a proximal portion of said handle, said actuator being operable to selectively move said dispensing system and said dispenser between said first and second positions.

* * * * *